US007805899B2

(12) United States Patent
Montgomery

(10) Patent No.: US 7,805,899 B2
(45) Date of Patent: Oct. 5, 2010

(54) HIGH IMPACT, MOISTURE RESISTANT WALL PANEL SYSTEM

(75) Inventor: John C. Montgomery, New Boston, NH (US)

(73) Assignee: Environmental Interiors, Inc., Hudson, NH (US)

( * ) Notice: Subject to any disclaimer, the term of this patent is extended or adjusted under 35 U.S.C. 154(b) by 0 days.

(21) Appl. No.: 12/422,943

(22) Filed: Apr. 13, 2009

(65) Prior Publication Data

US 2009/0313932 A1 Dec. 24, 2009

Related U.S. Application Data

(63) Continuation of application No. 12/144,955, filed on Jun. 24, 2008, now abandoned.

(51) Int. Cl.
*E04H 5/00* (2006.01)

(52) U.S. Cl. ..... 52/235; 52/506.06

(58) Field of Classification Search ..... 52/235, 52/489.1, 506.06, 508, 510–512, 506.03, 52/506.02

See application file for complete search history.

(56) References Cited

U.S. PATENT DOCUMENTS

| | | | | |
|---|---|---|---|---|
| 2,205,700 | A | 6/1940 | Smith | |
| 3,621,635 | A | 11/1971 | De Lange | |
| 3,935,049 | A * | 1/1976 | Schmidt et al. | 156/216 |
| 3,986,312 | A | 10/1976 | Calhoun et al. | |
| 3,996,703 | A | 12/1976 | Daniels | |
| 4,075,805 | A | 2/1978 | Bongiovanni | |
| 4,094,114 | A | 6/1978 | Burcham | |
| 4,296,580 | A | 10/1981 | Weinar | |
| 4,483,122 | A | 11/1984 | Crandell | |
| 4,506,484 | A | 3/1985 | Bartlett et al. | |
| 4,546,024 | A | 10/1985 | Brown | |
| 4,597,235 | A | 7/1986 | Olsen | |
| 4,607,471 | A | 8/1986 | Olsen | |
| 4,622,794 | A | 11/1986 | Geortner | |
| 4,628,656 | A | 12/1986 | Menchetti et al. | |
| 4,672,787 | A | 6/1987 | Murphy | |
| 4,724,638 | A | 2/1988 | Bezborodko | |
| 4,833,840 | A | 5/1989 | Kalischewski et al. | |
| 4,866,896 | A | 9/1989 | Shreiner et al. | |

(Continued)

FOREIGN PATENT DOCUMENTS

| | | |
|---|---|---|
| JP | 04052367 | 2/1992 |
| WO | WO 2008/067803 | 6/2008 |

OTHER PUBLICATIONS

Tong L., et al., "Effect of joint flexibility in adhesively bonded composites panel-to-flange joints", Composites. Part B, Engineering, (1998), 29(3), 287-298, Accession No. 1998-0409911 PASCAL (Nov. 1998) (1 page).

(Continued)

*Primary Examiner*—Jeanette E Chapman
*Assistant Examiner*—Daniel Kenny
(74) *Attorney, Agent, or Firm*—Greenberg Traurig, LLP; David J. Dykeman; David A. Fazzolare

(57) ABSTRACT

A high impact, moisture resistant, wall panel system and methods for mounting a high impact, moisture resistant wall panel to an existing structure are disclosed herein. A high impact, moisture resistant wall panel includes an inert substrate composed of a high density inorganic material, wherein the substrate is dimensionally stable, a laminate composed of a substantially rigid polymeric material, and an adhesive for engaging the laminate to the substrate.

20 Claims, 11 Drawing Sheets

U.S. PATENT DOCUMENTS

| | | | | |
|---|---|---|---|---|
| 4,974,382 | A | 12/1990 | Avellanet | |
| 5,038,539 | A | 8/1991 | Kelley et al. | |
| 5,155,958 | A | 10/1992 | Huff | |
| 5,170,603 | A | 12/1992 | Bartlett | |
| 5,400,560 | A | 3/1995 | Hellwig et al. | |
| 5,417,020 | A | 5/1995 | Dobija | |
| 5,469,685 | A * | 11/1995 | Nelson | 52/782.2 |
| 5,644,885 | A | 7/1997 | Eischeid | |
| 5,694,727 | A | 12/1997 | Dobija | |
| D405,547 | S | 2/1999 | Dobija | |
| 5,881,522 | A | 3/1999 | Dobija | |
| 5,896,710 | A | 4/1999 | Hoyle | |
| 5,974,753 | A | 11/1999 | Hsu | |
| 6,003,273 | A | 12/1999 | Elsholz et al. | |
| 6,202,377 | B1 | 3/2001 | Krieger | |
| 6,226,849 | B1 | 5/2001 | Beck et al. | |
| 6,226,947 | B1 * | 5/2001 | Bado et al. | 52/483.1 |
| 6,314,687 | B1 | 11/2001 | Schondelmayer et al. | |
| 6,341,457 | B1 | 1/2002 | Aerts et al. | |
| 6,470,647 | B2 | 10/2002 | Hsueh | |
| 6,565,919 | B1 * | 5/2003 | Hansson et al. | 427/203 |
| 6,601,355 | B2 | 8/2003 | Kreitz et al. | |
| 6,625,950 | B1 | 9/2003 | Shreiner et al. | |
| 6,718,717 | B2 | 4/2004 | Henderson et al. | |
| 6,748,997 | B2 | 6/2004 | Fricano et al. | |
| 6,803,110 | B2 * | 10/2004 | Drees et al. | 428/423.7 |
| 6,951,085 | B2 | 10/2005 | Hodges et al. | |
| 6,973,756 | B2 | 12/2005 | Hatzinikolas | |
| 7,007,433 | B2 | 3/2006 | Boyer | |
| RE39,091 | E | 5/2006 | Kuelker | |
| D537,544 | S | 2/2007 | Bledsoe et al. | |
| 7,454,866 | B2 | 11/2008 | Maurer | |
| 7,472,531 | B2 | 1/2009 | Fennelly | |
| 7,654,058 | B2 | 2/2010 | Hatzinikolas | |
| 7,658,040 | B2 | 2/2010 | Bennett et al. | |
| 2002/0108330 | A1 | 8/2002 | Yu et al. | |
| 2002/0124498 | A1 | 9/2002 | Knappe | |
| 2003/0150183 | A1 | 8/2003 | Egan | |
| 2004/0221535 | A1 | 11/2004 | Hatzinikolas | |
| 2005/0055931 | A1 | 3/2005 | Rochette | |
| 2005/0076585 | A1 | 4/2005 | Kelly | |
| 2005/0108957 | A1 | 5/2005 | Quesada | |
| 2005/0188634 | A1 | 9/2005 | Bolton et al. | |
| 2005/0229504 | A1 | 10/2005 | Bennett et al. | |
| 2005/0284062 | A1 | 12/2005 | Hsieh | |
| 2006/0053743 | A1 | 3/2006 | Hatzinikolas | |
| 2006/0059806 | A1 | 3/2006 | Gosling et al. | |
| 2006/0265988 | A1 | 11/2006 | Fujito et al. | |
| 2007/0022682 | A1 | 2/2007 | Morgenegg et al. | |
| 2007/0277449 | A1 | 12/2007 | Burns | |
| 2007/0283657 | A1 | 12/2007 | Pratt | |
| 2008/0104895 | A1 | 5/2008 | Deweerd et al. | |
| 2008/0155917 | A1 | 7/2008 | Bilge | |
| 2009/0031652 | A1 | 2/2009 | Ortega Gatalan | |
| 2009/0241444 | A1 | 10/2009 | Griffiths | |
| 2009/0313928 | A1 | 12/2009 | Montgomery | |
| 2009/0313935 | A1 | 12/2009 | Montgomery | |
| 2010/0000168 | A1 | 1/2010 | Weiser | |
| 2010/0083599 | A1 | 4/2010 | Meulemans | |
| 2010/0088992 | A1 | 4/2010 | Hatzinikolas | |
| 2010/0095607 | A1 | 4/2010 | Bennett et al. | |

OTHER PUBLICATIONS

Langdon G. S., et al., "Localised blast loading of fibre-metal laminates with a polyamide matrix", Composites. Part B. Engineering, (2007), 38(7-8), 902-913, Accession No. 2008-0224082 PASCAL (Oct. 2007) (1 page).

Zilov, A. G., et al., "Wall panels made from foamed plastic", Stroitel'nye Materialy (1970), (2), 17, Accession No. 1970:415888 CAPLUS (1970) (1 page).

Liu, Zihong (Dept. of Civil and Environmental Engineering Virginia Tech., Blacksburg, VA 24061), et al., "Development and evaluation of an adhesively bonded panel-to-panel joint for a FRP bridge deck system.", Journal of Composites for Construction v 12 n 2 2008 2008.p. 224-233, Accession No. 1976(11):1377 COMPENDEX (Mar. 2008) (1 page).

Dreger, Donald R., "Structural Plastic Panels.", Mach Des v 48 n 14 Jun. 10, 1976 p. 105-107, Accession No. 1976(11):1377 COMPENDEX (Jun. 10, 1976) (1 page).

Stratford, Tim, et al., "Shear strengthening masonry panels with sheet glass-fiber reinforced polymer.", Journal of Composites for Construction v 8 n 5 Sep./Oct. 2004. p. 434-443, Accession No. 2005(10):5623 COMPENDEX (Sep. 2004) (1 page).

Anderson, R. A., et al., "Development of Lightweight, Fire-Retardant, Low-Smoke, High-Strength, Thermally Stable Aircraft Floor Paneling. Final Report.", N79-21133/0/XAB; NASA-CR-160138, D6-48571-TN 60P; Jun. 1978 (1978) (1 page).

Nussbaumer T., et al., "Experimental and numerical investigation of the thermal performance of a protected vacuum-insulation system applied to a concrete wall", Applied energy, (2006), 83(8), 841-855, Accession No. 2006-0309922 PASCAL (Dec. 2006) (1 page).

Lutz, J. F., et al., "Evaluation of Synthetic Crossboards for Wood Panels. Forest Service Research Paper.", AD-A028 092/5/XAB; FSRP-FLP-277 22p; 1976, Accession No. 1976 (40): 00902 NTIS (1976).

Jeffrey D. Lindsay, et al., "High-bulk Tissue Laminates for Building Materials and Other Purposes.", http://www.jefflindsay.com/tissue.shtml, Oct. 6, 2003 (9 pages).

Kojima Eiji (Toyoda Gosei Co., Ltd.), et al., "Measurement of the laminate temperature in vacuum thermoforming", Toyoda Gosei Technical Review; vol. 41;No. 1;p. 26-28(1999) http://sciencelinks.jp/j-east/article/199918/000019991899A0692939.php, (1999) (1 page).

J. Fricke, et al., "Vacuum Insulation Panels—Exciting Thermal Properties and Most Challenging Applications", International Journal of Thermophysics vol. 27, No. 4/ Jul. 2006 http://www.springerlink.com/content/n52717684363557q/, (1 page).

"Vacuum-Laminating 3-D Vinyl Parts.", Wood & Wood Products; Wednesday, Dec. 1, 1999 http://www.allbusiness.com/furniture-related/office-furniture-including/373282-1.html, (1 page).

"Vacuum Formed Custom Interior Parts—New Castle Industries Offering", M.C. Gill Corporation; Aug. 12, 2004, http://www.mcgillcorp.com/news/news040812.html, (1 page).

"Vacuum Insulation Panels.", HiPTI-High Performance Thermal Insulation IEA/ECBCS Annex 39 (Sep. 2005) http://www.vip-bau.de/pdf/literatur/Annex39_A.pdf, (159 pages).

"Fiberglass Showerwall", Quality Plumbing Products, E.L. Mustee & Sons Inc. http://mustee.com/pdfsidoc/4showerw/si-192.pdf, (Aug. 1, 2003) (6 pages).

Bathcove Wall Sets, http://www.hytec.ca/onlinecatalog/pdf/1048162_wall_set3063_2.pdf (Oct. 29, 2007) (3 pages).

R. El-Hacha, et al., "FRP—A Potential Blast Retrofitting Material" 1st Specialty Conference on Disaster Mitigation (May 23-26, 2006) http://montreal.ciise.concordia.ca/Conferences/CSCE%20Annual%20Conference—Proceeding(Calgary%202006)/PDF%20Files/DMPapers/Paper%20DM-028.pdf, (13 pages).

"Cement Board Construction", Mar. 21, 2006 (16 pages) http//www.cgcinc.com/handbookAssets/PDFs/e/Handbook_12574_CP_C4.pdf.

Office Action in U.S. Appl. No. 12/144,955 mailed Jun. 11, 2009.

Office Action in U.S. Appl. No. 12/366,607 mailed Jun. 23, 2009.

U.S. Appl. No. 12/144,955, Montgomery, filed Jun. 24, 2008.

U.S. Appl. No. 12/336,607, Montgomery, filed Jun. 23, 2008.

"Cement Board Construction", Mar. 21, 2006 pp. 139-154 http//www.cgcinc.com/handbookAssets/PDFs/e/Handbook_12574_CP_C4.pdf.

Office Action in U.S. Appl. No. 12/366,607 mailed Feb. 4, 2010.

* cited by examiner

HIGH IMPACT, MOISTURE RESISTANT WALL PANEL SYSTEM

RELATED APPLICATION

This application is a Continuation of U.S. Utility application Ser. No. 12/144,955, filed Jun. 24, 2008, still pending, the contents of which are incorporated by reference herein in its entirety.

BACKGROUND

1. Field

The presently disclosed embodiments relate to wall panel systems, and more particularly to a high impact, moisture and flame resistant wall panel system.

2. General Background

Existing wall panel systems suffer from design inefficiencies that lead to expensive and time consuming panel construction, panel repair and panel replacement. Existing wall panel systems often use a fiberboard substrate that is composed of organic material. Because the organic substrate is not dimensionally stable, the substrate requires a vapor barrier. Without a vapor barrier the organic substrate would expand upon absorbing moisture or contract upon losing moisture when humidity changes, thus increasing the risk of delamination of the panel laminate, disconnection of the panels from the attachment system, and deformation of the finished panels.

Installation of existing wall panel systems over walls having irregular surfaces often use a construction grade adhesive. The construction grade adhesive often used by existing wall panel systems requires removal of multiple adjacent panels in succession to replace a single damaged panel. Individual panels of existing wall panel systems are often not removable without affecting adjacent panels. The lack of substantial edge bonding of the panel laminate to the panel substrate decreases impact resistance and increases the risk of delamination of the laminate from the substrate. The contours of the organic substrate also make it difficult to vacuum form the laminate onto the substrate with architectural detailing without imperfections in the substrate showing on the surface finish. Thus, there is a need in the art for a high impact, moisture resistant wall panel system made from a dimensionally stable substrate without a vapor barrier.

SUMMARY

A high impact, moisture resistant wall panel system and methods for mounting wall panels to an existing structure are disclosed herein. According to aspects illustrated herein, there is provided wall panel system that includes a plurality of panels, each panel comprising an inert substrate composed of a high density inorganic material, wherein the substrate is dimensionally stable, and a laminate composed of substantially rigid polymeric material, wherein an adhesive secures the laminate to the substrate.

According to aspects illustrated herein, there is provided a wall panel that includes an inert substrate composed of a high density inorganic material, wherein the substrate is dimensionally stable, a laminate composed of a substantially rigid polymeric material, and an adhesive for engaging the laminate to the substrate.

According to aspects illustrated herein, there is provided a method of mounting a high impact, water resistant panel to an existing structure that includes providing at least one high impact, water resistant panel having a back face and a front face, wherein the panel has a mounting member, providing at least one wall mount having a first end and a second end, wherein the first end of the wall mount is secured to an existing structure, at least one mounting member has a first end secured to the back face of the panel, and engaging a second end of the mounting member with the second end of each wall mount, to secure the panel to the existing structure, wherein the panel is substantially parallel to the existing structure.

BRIEF DESCRIPTION OF THE DRAWINGS

The presently disclosed embodiments will be further explained with reference to the attached drawings, wherein like structures are referred to by like numerals throughout the several views. The drawings shown are not necessarily to scale, with emphasis instead generally being placed upon illustrating the principles of the presently disclosed embodiments.

Figure 1:
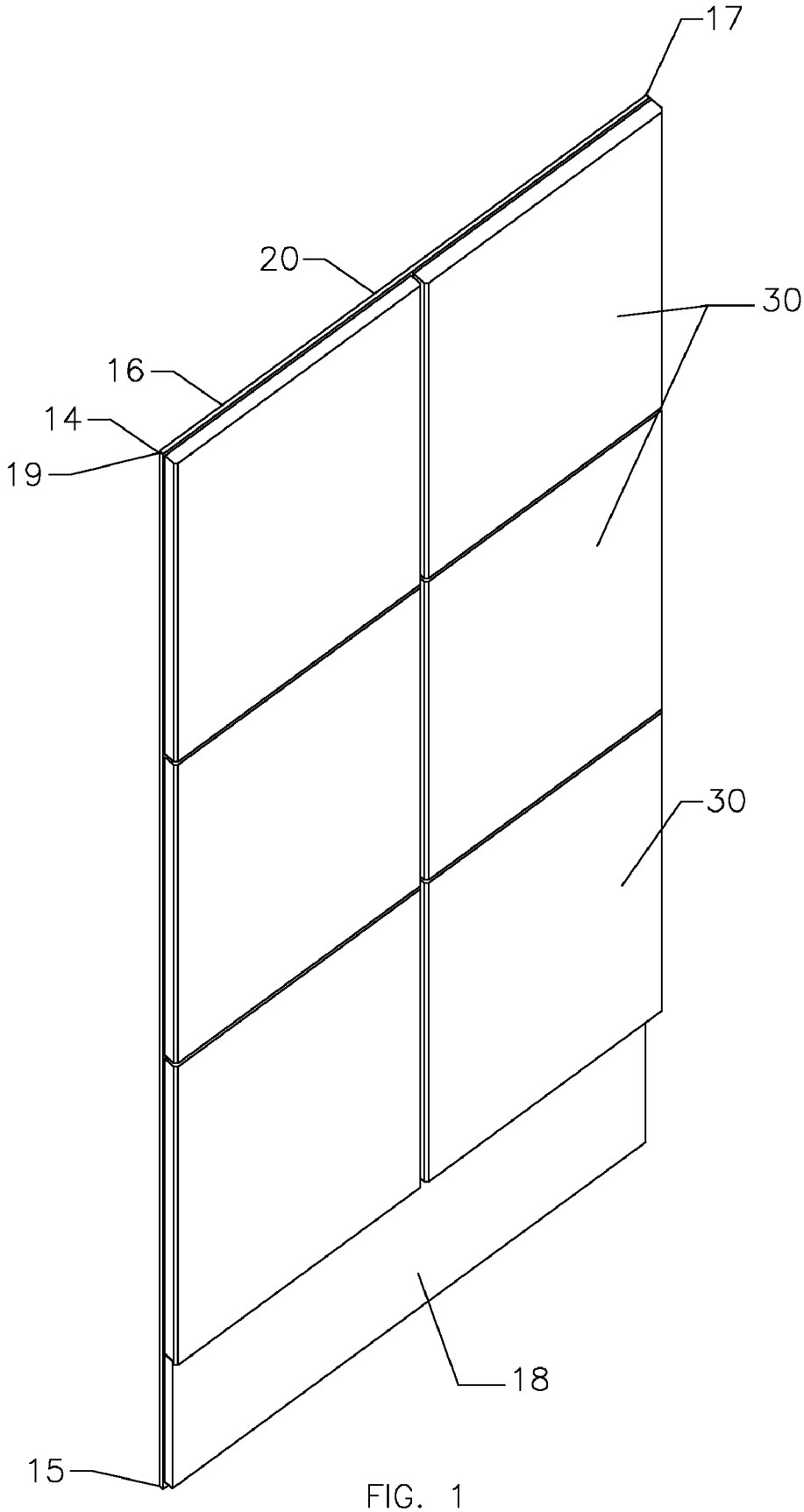
FIG. 1 is a perspective view of a wall panel system of the presently disclosed embodiments.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

A wall panel system with removable high impact, moisture resistant panels that provides improved design efficiency and confers structural advantages is disclosed herein. Structural advantages of the panels and the wall panel system of the presently disclosed embodiments include, but are not limited to, increased impact resistance, moisture resistance without requiring additional protective coatings or additional protective layers, and fire resistance without requiring additional fire retardants. Improved design efficiencies of the panels and the wall panel system of the presently disclosed embodiments include, but are not limited to simplified panel construction, panel installation, panel repair, panel replacement, panel dimensional stability, a surface finish laminate that can be vacuum formed for architectural detailing, and substantial edge bonding to reduce the risk of delamination.

As used herein, the term "dimensionally stable" refers to a material characterized by dimensions which remain constant under normal temperatures and pressures and also remain substantially constant with changes in temperature and humidity. A dimensionally stable material maintains its size and shape in changing environmental conditions. Dimensionally stable should also be understood to mean that a material, for instance a substrate, will not significantly distort, decompose, or change due to changes in ambient temperature or humidity. A dimensionally stable material absorbs or loses a negligible amount of moisture upon changes in humidity. For example, as humidity increases a dimensionally stable material will not substantially expand if it absorbs moisture and as humidity decreases a dimensionally stable material will not substantially contract when it loses moisture. Dimensionally stable also refers to the ability of a material to remain flat upon changes in temperature and humidity. Thus, the dimensionally stable substrate of the presently disclosed embodiments will not substantially warp, expand, or contract so the laminate remains engaged to the substrate and does not detach from the substrate.

As used herein, the term "inert" refers to a material which does not substantially change or react upon contact with another substance.

As used herein, the term "inorganic" refers to a material that is substantially free of organic material. In an embodiment, a substrate of a panel of the present disclosed embodiments comprises inorganic material that is substantially free of organic material. It is possible that a small amount of organic material may be present in the inorganic material.

As used herein, the term "laminate" includes any material that may be used as a structure that may be attached to another structure. A laminate may comprise any composition, size, shape, or form. In an embodiment, the laminate used to form a panel of the presently disclosed embodiments comprises substantially rigid polymeric material. For example, a laminate may be formed as a thermoplastic sheet having a desired thickness and a customizable finish.

As used herein, the term "substrate" includes any material that may be used as structure to which another structure may be attached onto. A substrate may comprise any composition, size, shape, or form. In an embodiment, the substrate used to fabricate a panel of the presently disclosed embodiments comprises a high density, inert, inorganic material, wherein the substrate is dimensionally stable. For example, a substrate may be fabricated as a sheet having a desired thickness.

As shown in the perspective view of FIG. 1, an isolated wall segment of a wall panel system 20 of the presently disclosed embodiments, spanning from a first end 14 to a second end 17 across an existing structure 16, comprises a plurality of panels 30 that are configurable to form a wall system expanding beyond the isolated wall segment displayed in FIG. 1. Typically, a wall of the wall panel system, as shown in FIG. 1, will have panels 30 spanning from a ceiling 19 all the way down to a base 18. Although FIG. 1 shows three pairs of adjacent side-by-side panels stacked upon each other from a floor 15 to the ceiling 19 in vertical fashion, a wall panel system may comprise any number of panels 30 stacked in horizontal orientation combined with any number of panels 30 stacked in vertical orientation depending on the conditions and requirements of a particular field site. For example, a wall panel system 20 may require at least one or more panels 30 stacked in vertical orientation and may also require at least one or more panels 30 stacked in horizontal orientation across an existing structure.

In an embodiment, a plurality of panels 30 of the presently disclosed embodiments may be assembled to form a wall panel system 20 designed to be installed directly an existing structure 16. In an embodiment, an existing structure 16 comprises a wall. In an embodiment, an existing structure 16 comprises an exterior wall. In an embodiment, an existing structure 16 comprises an interior wall. For example, the wall panel system may be installed directly over existing walls or over an existing foundation such as wood framing or a concrete foundation. Additionally, the wall panel system 20 may be installed over an existing structure made of a variety of materials. For example, the wall panel system 20 may be installed over existing structures including, but not limited to concrete block, brick, steel, ceramic tile, or dry wall. The wall panel system 20 may be installed over existing structures having a variety of surface variations, such as smooth surfaced structures or structures having irregular surfaces and uneven geometry.

Figure 9:
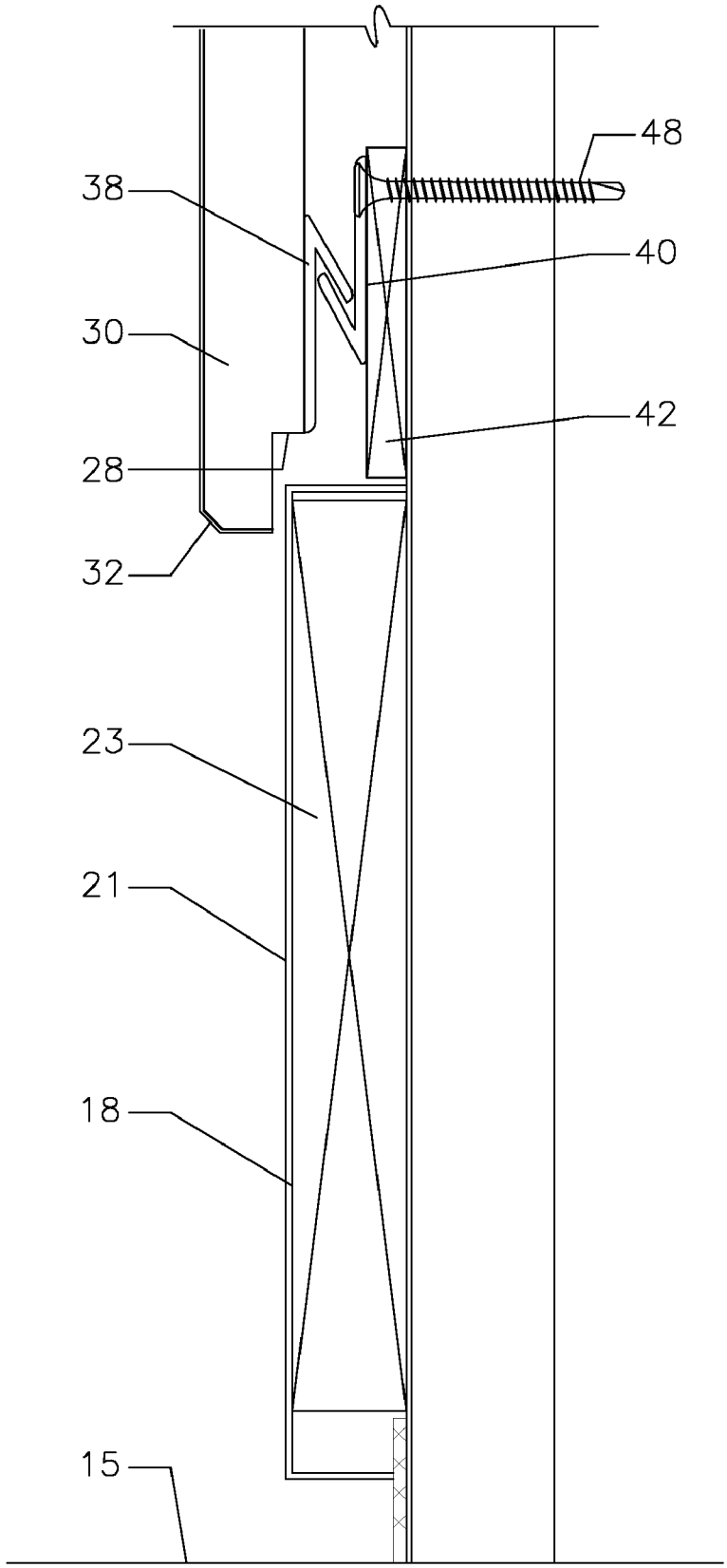
FIG. 9 is a cross-section view of a representative wall panel system base between a panel and a floor.

The base 18 conceals and finishes the joints where the wall panel system meets the floor. In an embodiment, the base 18 comprises a base plate 21 (as shown in FIG. 9) and a blocking 23 (as shown in FIG. 9), wherein the blocking acts as a backer to the base plate and provides support for and reinforces the base. In an embodiment, the base 18 comprises a stainless steel plate 21 (as shown in FIG. 9) and a wooden blocking 23 (as shown in FIG. 9). In an embodiment, the base 18 comprises a sized and cut panel that is fabricated to fit between a panel 30 and the floor 15. In an embodiment, the base 18 comprises a series of sized and cut panels that are fabricated to fit between a panel 30 and the floor 15 spanning from a first end 14 to a second end 17 across an existing structure 16. The base may be composed of metal, plastic, wood, block, brick, vinyl, or other materials known to those skilled in the art.

Figure 2:
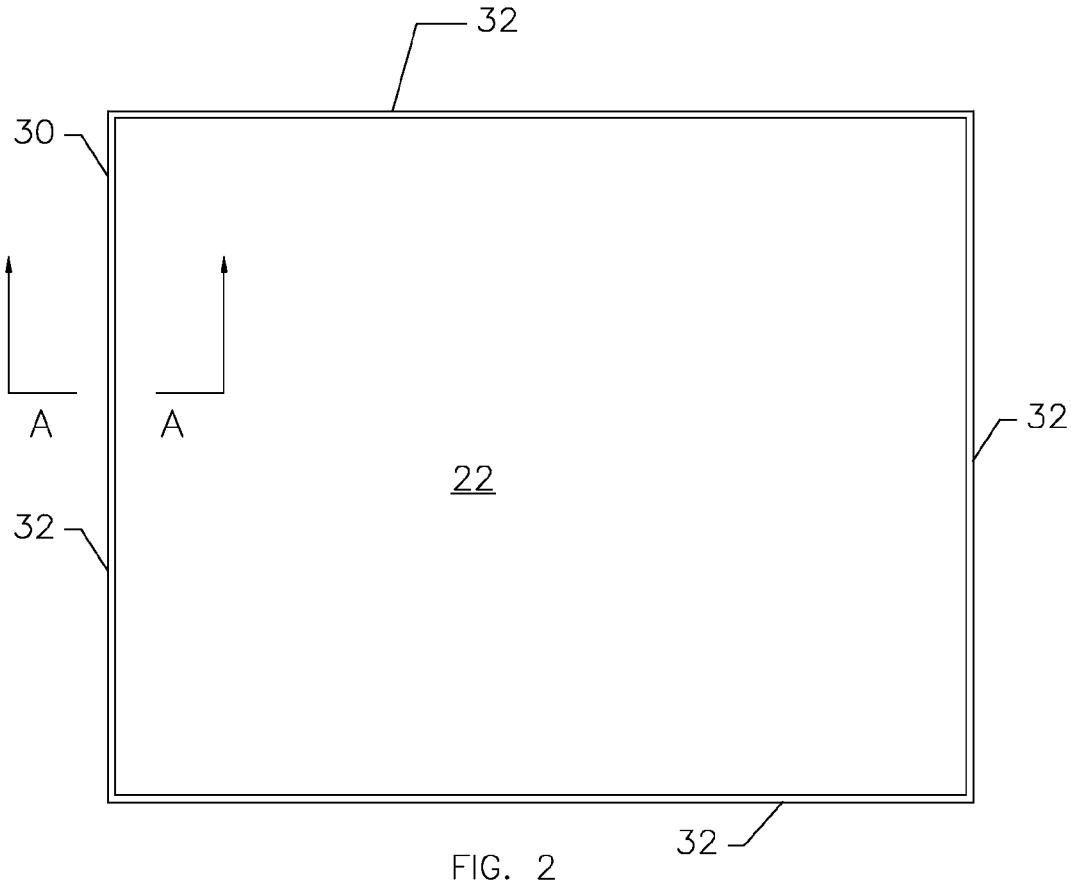
FIG. 2 is a front view of a panel of the presently disclosed embodiments.

FIG. 2 shows a front view of a panel 30, and a laminate 22. In an embodiment, the laminate has at least one beveled 32 edge. In an embodiment, each panel 30 comprises a substrate and a laminate, wherein the laminate is secured to the substrate with an adhesive. In an embodiment, each panel comprises an inert substrate of high density inorganic material, wherein the substrate is dimensionally stable; and a laminate of substantially rigid polymeric material, wherein an adhesive secures the laminate to the substrate.

Figure 3:
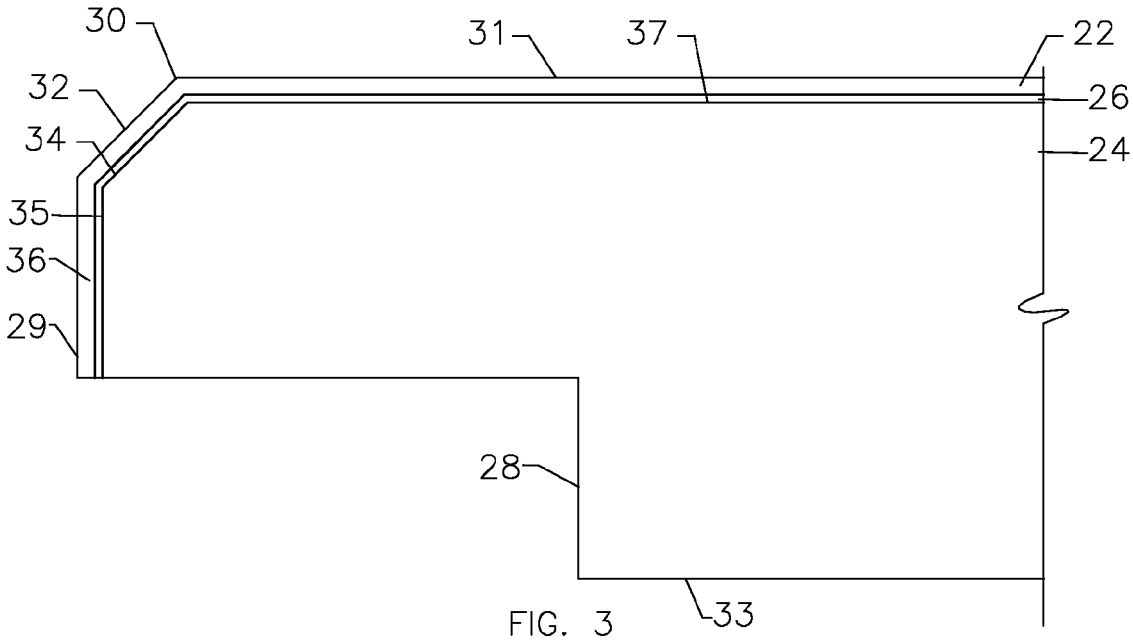
FIG. 3 is a cross-section view of an edge portion of a panel, taken along lines A-A of FIG. 2.

FIG. 3 shows a cross-sectional view of an edge portion of a panel 30 taken along lines A-A of FIG. 2. In an embodiment, a panel 30 includes a substrate 24 and a laminate 22 bonded together by an adhesive 26. In an embodiment, the panel includes an undercut edge 28 at a juncture between at least one side edge 29 of the panel and a back face 33 of the panel. In an embodiment, the panel includes a flange 36 extending from at least one edge of the laminate. In an embodiment, the flange 36 is substantially perpendicular to a front face 31 of the panel 30. In an embodiment, the panel 30 includes a bevel 34 at a juncture between at least one side edge 35 of the substrate and a front face 37 of the substrate. In an embodiment, the panel includes a beveled 32 edge at a juncture between the flange 36 and the front face of the panel 31.

The substrate 24 of the presently disclosed embodiments is strong and durable and includes one or more of the following characteristics: UL approved fireproof, fire resistance without requiring additional fire retardants, ASTM rated mold proof, ASTM rated waterproof, moisture resistant without requiring additional protective barriers, ASTM rated insect free, ASTM rated fungus free, interior or exterior compatible, high impact, hurricane tested, asbestos free, silica free, or sound suppressing. The substrate 24 may comprise inert material, inorganic material, high density material, ultra-high-density material or dimensionally stable material.

In an embodiment, the substrate 24 comprises inert, inorganic, high density material, wherein the substrate is dimensionally stable.

The substrate 24 of the presently disclosed embodiments is inert. The substrate 24 does not substantially change or react upon contact with another substance. An inert substrate maintains its characteristics, size, and shape when exposed to changing environmental conditions. Providing an inert substrate adds to the strength, weight, and fire resistance of the substrate. To provide panels for a wall panel system that is useful in a variety of environments, panels should be capable of adapting to environmental changes without warping, expanding, or contracting. The inert substrate 24 is less likely to react in response to contact with moisture or fire and less likely to react in response to changes in temperature or humidity. Providing an inert substrate allows the substrate to adapt to environmental changes and remain dimensionally stable. Thus, the inert substrate provides for a panel that is long lasting and durable under a variety of conditions providing for a durable wall panel system that has a longer-life and is subject to decreased maintenance costs over time.

The substrate 24 of the presently disclosed embodiments is inorganic. The inorganic substrate 24 is substantially free of organic material. Wall panel systems require panels that comport with public safety codes, such as fire safety, and panels that are durable.

Organic materials are made from natural processes and may be more flammable, subject to increased wear, and subject to decomposition. Organic materials may not be dimensionally stable because organic materials may absorb too much moisture as humidity increases and may lose too much moisture as humidity decreases, subjecting organic materials to warping, expanding or contracting in response to environmental changes in temperature and humidity.

Inorganic materials are composed of synthetic materials that are less flammable, designed to be durable, and less subject to decomposition. As humidity increases, inorganic materials will absorb a negligible amount of moisture and as humidity decreases inorganic materials will lose a negligible amount of water such that the inorganic material will not substantially warp, expand, contract, or shrink. The inorganic substrate provides for a long lasting and durable panel that helps prevent fire spreading and helps prevents the panel from warping, expanding or contracting, thus decreasing the risk of delamination. In an embodiment, the inorganic material includes recycled materials or recovered materials.

The substrate 24 of the presently disclosed embodiments has a high density. The density of a material determines its resistance to wear and abrasion, its durability in use, and the costs required to maintain it. The high density of the substrate provides a panel with impact resistance. Higher density materials provide greater impact resistance than materials having less density. Impact resistance is important for wall panel systems because wall panel systems are used in places where walls are subject to damage from increased abuse from objects being transported about the place. The high density substrate 24 provides a panel with impact resistance that will be resistant to wear and abrasion, durable, and decrease maintenance costs. The high density substrate 24 provides a panel that can be used in a variety of places where wall panel systems are desired. In an embodiment, the high density substrate 24 has a density of about 50 pounds per cubic foot or greater.

The substrate 24 of the presently disclosed embodiments is dimensionally stable. The dimensional stability of a material, as the material responds to changes in temperature and moisture content, affects the manner in which the material may be detailed and constructed to combine with other materials. The dimensionally stable substrate 24 is capable of maintaining substantially constant dimensions with changes in temperature and humidity. The dimensionally stable substrate 24 is less likely to significantly distort, decompose, or change substantially due to changes in ambient temperature and humidity. Providing a dimensionally stable substrate 24 decreases the chances that changes in temperature and moisture will alter the dimensions of the substrate and affect other components of the wall panel system. Providing a dimensionally stable substrate 24 provides for longer lasting and more durable panels since the panels are less subject to deformation under a variety of conditions. For example, the dimensionally stable substrate 24 absorbs or loses a negligible amount of water upon changes in temperature and humidity. The dimensionally stable substrate 24 will not substantially warp, expand, contract, or shrink. Thus, the dimensionally stable substrate 24 will remain engaged to a laminate and the laminate will not substantially detach from the dimensionally stable substrate 24. The dimensionally stable substrate 24 provides a wall panel system that has a longer-life, thus reducing maintenance and repair costs over time.

The substrate 24 provides moisture resistance without requiring additional protective coating or layering. Moisture resistance aids development of long-lasting and durable panels, which are necessary for producing long-lasting and durable wall panel systems. If a substrate absorbs or loses too much moisture, the laminate may detach from the substrate. The substrate 24 of the presently disclosed embodiments prevents panel warping, expanding, and contracting without requiring a vapor barrier. The presently disclosed embodiments provide a high density inorganic material that causes the substrate 24 of a panel 30 to be non-absorbing. Moisture and water vapor are not absorbed into the panel. In an embodiment, the substrate 24 is ASTM rated waterproof. Thus, the presently disclosed embodiments confer panel construction efficiencies by providing moisture resistance without requiring additional coatings or protective layers during panel formation.

The moisture resistant substrate 24 permits wall panel system installation to begin before a field site under construction is completely dry. Thus, the substrate 24 provides a panel that confers construction efficiencies that speed up the wall panel system installation process.

The substrate 24 provides fire resistance without requiring compounding of additional fire retardants into the substrate. Fire resistance is important for developing durable panels and for developing panels that comport with public safety codes. Fire resistance helps prevent the spread of fires. A substrate having a prevalence of organic materials in the substrate may require the addition of fire retardants during manufacturing of the substrate. By providing an inorganic substrate, the requirement to add fire retardants into the substrate during the substrate manufacturing process is eliminated. Thus, the presently disclosed embodiments confer panel construction efficiencies by providing fire resistance without requiring the addition of fire retardants to the substrate 24 during panel formation.

The substrate 24 provides consistent fire resistance throughout the entire composition of the substrate. The fire resistance is homogenous throughout the entire substrate material, not just coated on the outside layer of the substrate. Thus, the homogenously fire resistant substrate 24 does not require addition of fire-retardant coatings after field modifications, including cutting a panel, are made to a panel.

In an embodiment, the substrate 24 is UL approved fire proof. The substrate 24 is ASTM class A fire rated. In an embodiment, the substrate 24 is approved for 1-hour, 1½-hour, 2-hour, 3-hour and 4-hour fire resistant wall systems.

The substrate 24 may comprise any composition and may be sized, shaped, and fabricated to any desired parameters. For example, the substrate 24 may be any desired thickness, such as ⅛, ¼, ⅜, 7/16, 9/16, ⅝, ¾ of an inch or larger. In an embodiment, the substrate 24 comprises a sheet. In an embodiment, a substrate 24 sheet is prepared by forming true edges, square corners, and the required dimensions to precisely close tolerances. A juncture between the back face 33 and each side edge 35 of the substrate 24 sheet is cut so as to leave an undercut 28 along each edge. The substrate 24 sheet also contains a bevel 34 extending between each side edge 35 and the front face 37 of the substrate.

In an embodiment, the substrate is composed of a UL approved fire resistant, water resistant, high-impact substrate that will not disintegrate when immersed in water or exposed to prolonged freezing and thawing cycles. In an embodiment, the substrate may be composed of any combination of inorganic materials including, but not limited to, magnesium oxide, magnesium chloride, finely powdered stone, fine plastic fibers, polyester fibers, or other inorganic materials known to those skilled in the art.

The laminate 22 is formulated for extreme resistance to impact, chemicals, and cleaning agents. The laminate 22 is engineered to be formed over components with deep recesses. The laminate 22 seamlessly encapsulates the top and side surfaces of routed substrates, thus diminishing the need for edge banding. In an embodiment, the laminate 22 of the presently disclosed embodiments may comprise one or more of the following: thermoplastic material, polymeric material, rigid material, substantially rigid material. In an embodiment, the 22 laminate comprises a sheet. In an embodiment, the laminate 22 comprises a thermoplastic sheet of substantially rigid polymeric material. In an embodiment, the laminate sheet comprises an alloy of any combination of one or more of the following: polyvinyl chloride, acrylic, chlorinated polyvinyl chloride. In an embodiment, the laminate 22 sheet includes an alloy of polyvinyl chloride and a lesser amount of acrylic that is compounded with fire retardants and smoke inhibitors so that it has a Class 1/A when tested according to ASTM E-84. Processing aids, impact modifiers, heat stabilizers, lubricants and pigments may be added to the composition of the laminate sheet as desired.

In an embodiment, the laminate 22 sheet may have a thickness of about 0.02 inch or greater. Those skilled in the art will recognize that various thicknesses of the laminate sheet ranging from about 0.02 inch to about 0.06 inch or greater are within the spirit and scope of the presently disclosed embodiments.

In an embodiment, the laminate 22 is composed of a durable thermoplastic alloy extruded in a range of colors, patterns, textures, thicknesses and grade.

In an embodiment, the laminate 22 sheet is sized and shaped and then may be vacuum-formed or thermoformed. In an embodiment, the laminate sheet 22 may be both vacuum formed and thermoformed. Optionally, vacuum-forming or thermoforming may produce a right-angle flange 36 along each side edge of the laminate and a beveled edge 32 forming a juncture between the flange 36 and a front face 31 of the panel.

Thermoforming comprises heating a laminate to a point at which it melts around a substrate. In an embodiment, a laminate 22 sheet is thermoformed onto a pre-cut commercially available substrate sheet 24. Thermoforming a laminate onto a substrate produces a very tight fit of the laminate to the substrate. Typically, an adhesive is applied to the substrate before the substrate and laminate are placed into an oven to facilitate attachment of the laminate to the substrate. Thermoforming is suited for producing a finished surface on the laminate comprising the shape over which the laminate is melted onto as textured surfaces produced on the finished faces of a laminate are limited to those textures inherent to the laminate materials. The thicker the laminate, the less customizable finishes can be produced with thermoforming as thermoforming is not well suited to produce smaller textures and detailed patterns.

Vacuum forming comprises a reverse mold into which a laminate is heated and melted into. The mold has tiny holes in which air is pulled through to the laminate to create a vacuum suction of the laminate into the mold. During cooling, an adhesive is applied to a substrate backer that is pressed into the underside of the laminate while the laminate is still in the mold. Melting the laminate into a reverse mold in this manner enables the laminate to acquire the shape and detailed texturing of the mold. The level of detail of laminate finishes produced by vacuum forming is not limited by the thickness of the laminate. Thus, vacuum forming can provide more detailed surface textures and designs than thermoforming.

Vacuum forming provides for a customizable finish that permits a variety of surface applications comprising numerous patterns and textures applicable to laminates of a wide range of thicknesses. In an embodiment, a panel 30 comprising a laminate 22 bonded with an adhesive 26 to a substrate 24 has a customizable finish. The customizable finish can be a variety of embodiments, such as textured or patterned. The technology for vacuum-forming or thermoforming thermoplastic sheets is known in the art, as are the techniques for making molds by replicating naturally occurring textures (e.g., wood grain, leather, stucco, or similar textures) or specially created textures and designs. A customizable finish may be used to portray corporate identity.

In an embodiment, a preformed laminate 22 is bonded with an adhesive 26 to a sized substrate 24. The adhesive assists in creating a strong, durable bond between the laminate 22 and the pre-cut substrate 24. The adhesive 26 is selected for compatibility with the polymers of the laminate 22 and the composition of the substrate 24. The adhesive 26 can also be selected for flame resistance and smoke resistance according to a Class 1 Fire Rating (ASTM-E84-87A). In an embodiment, the adhesive is a non-water-soluble adhesive. In an embodiment, the adhesive comprises glue. In an embodiment, the adhesive comprises a contact-based adhesive. In an embodiment, the adhesive requires a catalyst. In an embodiment, the adhesive does not require a catalyst. In an embodiment, the adhesive comprises a vapor resistant adhesive.

In an embodiment, the laminate 22 may contiguously engage the entire front face 37 and may contiguously engage a plurality of side edges 35 of the substrate 24. In an embodiment, the flange 36 and the beveled edge 32 of the laminate 22 are not bonded to the substrate 24. In an embodiment, as FIG. 3 shows, the flange 36 and the beveled edge 32 of the laminate 22 sheet are contiguously bonded to the substrate 24 sheet along a plurality of the side edges 35 of the substrate 24 sheet. In an embodiment, the flange and beveled edge of the laminate may be completely bonded to the substrate sheet along at least one of the side edges of the substrate sheet or the flange and beveled edge of the laminate sheet may be partially bonded to or not bonded at all to the substrate sheet along at least one of the side edges of the substrate sheet.

Bonding the flange 36 to the side edge 35 of the substrate 24 ("edge bonding") in this manner provides for maximum adhesion between the laminate and the underlying substrate resulting in increased impact and moisture resistance. By bonding continuously between the laminate and the substrate fully throughout the front face and substantially throughout a plurality of sides of the panel, the bond is strengthened and the likelihood of detachment of the laminate is decreased, thus improving panel durability and impact resistance. Edge bonding may provide additional moisture resistance by removing space between the laminate and the substrate near the edges where moisture resulting from changes in ambient humidity is likely to seep in. Edge bonding seals the laminate to the substrate sides preventing moisture from getting between the laminate and substrate. Thus, edge bonding decreases the potential for detachment of the laminate from the substrate and provides a dimensionally stable panel that has increased impact resistance.

Figure 4:
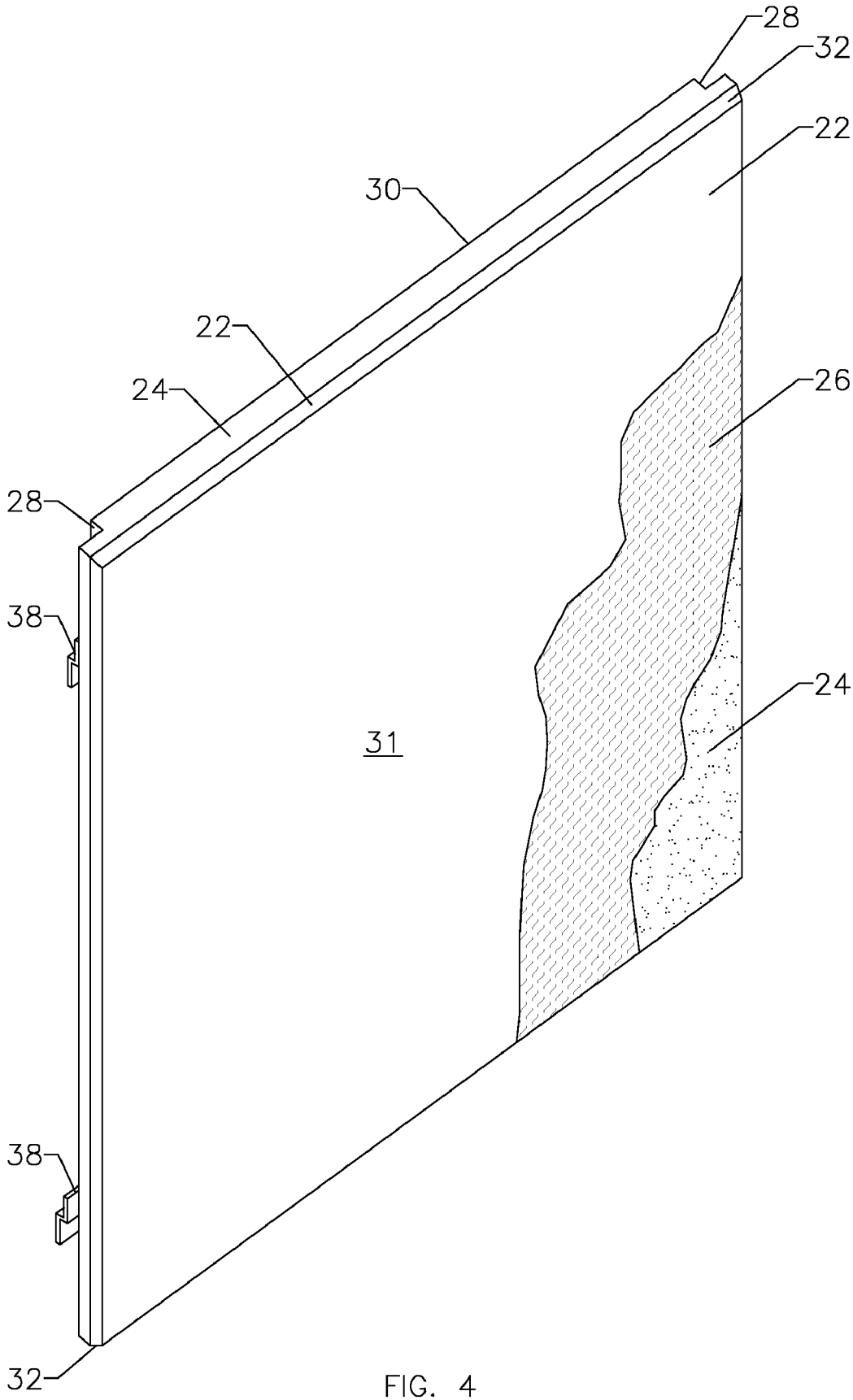
FIG. 4 is a perspective cutaway view showing the layers of a panel.

FIG. 4 shows a perspective view of a panel 30 having its front face 31 cutaway to reveal the layers of the laminate 22, the substrate 24, and the adhesive 26. A panel 30 is customizable according to required design parameters.

A method of making a panel is disclosed herein. For example, fabrication drawings of the substrate and requisite mold drawing requirements based upon panel size requirements are produced. In an embodiment, the substrate comprises a backer board. Once parameters for the substrate and mold requirements are complete, the reverse mold components for vacuum forming are fabricated. The substrate is then cut to the specified shapes and sizes as required on a computer numerically controlled router. Simultaneously, pilot holes to guide field attachment of the mounting members 38 are predrilled. In an embodiment multiple panels are nested. For example, multiple panels are cut out of the same substrate sheet or backer board sheet at the same time. To further facilitate panel manufacture, as many molds as will fit on a given vacuum table are loaded onto the vacuum table at the same time. The laminate is then stretched across the molds and then heated. As the laminate softens, the vacuum from the vacuum table suctions the melted laminate into the molds. The molds comprise various designs according to the fabrication drawings. The mold assemblies are then removed from the vacuum table after a fixed time interval, depending on the thickness of the laminate to be adhered to the substrate, and put onto a table to be cooled. While the laminate is cooling, the adhesive is applied to the substrate and the substrate pressed into the underside of the molded laminate. Pressing the substrate into the laminate while the laminate is cooling provides a precision fit between the substrate and laminate, thus facilitating approximately complete bonding at the perimeter of the panels. Thus, no loose edges remain at the perimeter of the finished panels further facilitating a dimensionally stable panel that is impact resistant and is moisture resistant.

Those skilled in the art will recognize that the substrate may be cut to the specified shapes and sizes using a computer numerically controlled router, a hand router, a table saw, a wall saw, a dado blade, or similar cutting devices known to those skilled in the art. After the substrate is cut, pilot holes to guide field attachment of the mounting members 38 are drilled into the substrate.

A method for fabricating a panel 30 includes providing a substrate 24; and securing a laminate 22 to the substrate with an adhesive 26. In an embodiment, a method for fabricating a panel includes providing an inert substrate of high density inorganic material, wherein the substrate is dimensionally stable; and providing a laminate of substantially rigid polymeric material, wherein an adhesive secures the laminate to the substrate. In an embodiment, a method for fabricating a panel includes providing an inert substrate of high density inorganic material, wherein the substrate is dimensionally stable; providing a laminate of substantially rigid polymeric material, vacuum forming the laminate onto the substrate, wherein an adhesive is first applied to the substrate, wherein the laminate contiguously engages a front face and a plurality of side edges of the substrate. In an embodiment, a method for fabricating a panel includes providing a substrate, wherein the substrate is cut on a router according to panel size requirements; placing at least one mold onto a vacuum table, wherein the mold is fashioned to provide a customizable finish; stretching a laminate across the molds, wherein the laminate is heated; suctioning the laminate into the mold, wherein the suctioning is provided by a vacuum; removing the mold from the vacuum table; wherein the mold may cool; applying an adhesive to the substrate; pressing the substrate into the underside of the molded laminate.

A panel 30 may have various dimensions. Panels 30 are produced in sizes up to 4×10 feet, and beveled and undercut edges are formed along all sides. In an embodiment, a panel with 4×10 feet dimensions is provided. In an embodiment, a panel with 4×9 feet dimensions is provided. In an embodiment, a panel with 4×8 feet dimensions is provided. As required, parts or all of at least one of the edges may be trimmed away in sizing and shaping a final panel for installation.

The undercut edge 28 has a depth not less than, and preferably approximately equal to, the length necessary to accommodate a mounting system. Specific members of the mounting system for which the undercut portion can be cut to accommodate include, but are not limited to corner members, brackets or moldings, end brackets or moldings, base, base brackets or moldings, wall mounts or mounting members, shims, end members, corner members, inside corner guards, outside corner guards, or extrusions. Mounting members or wall mounts may include, but are not limited to clips, brackets, screws, connectors, or extrusions. Those of skill in the art will recognize the various types of extrusions that may be used within the spirit and scope of the presently disclosed embodiments.

Figure 5:
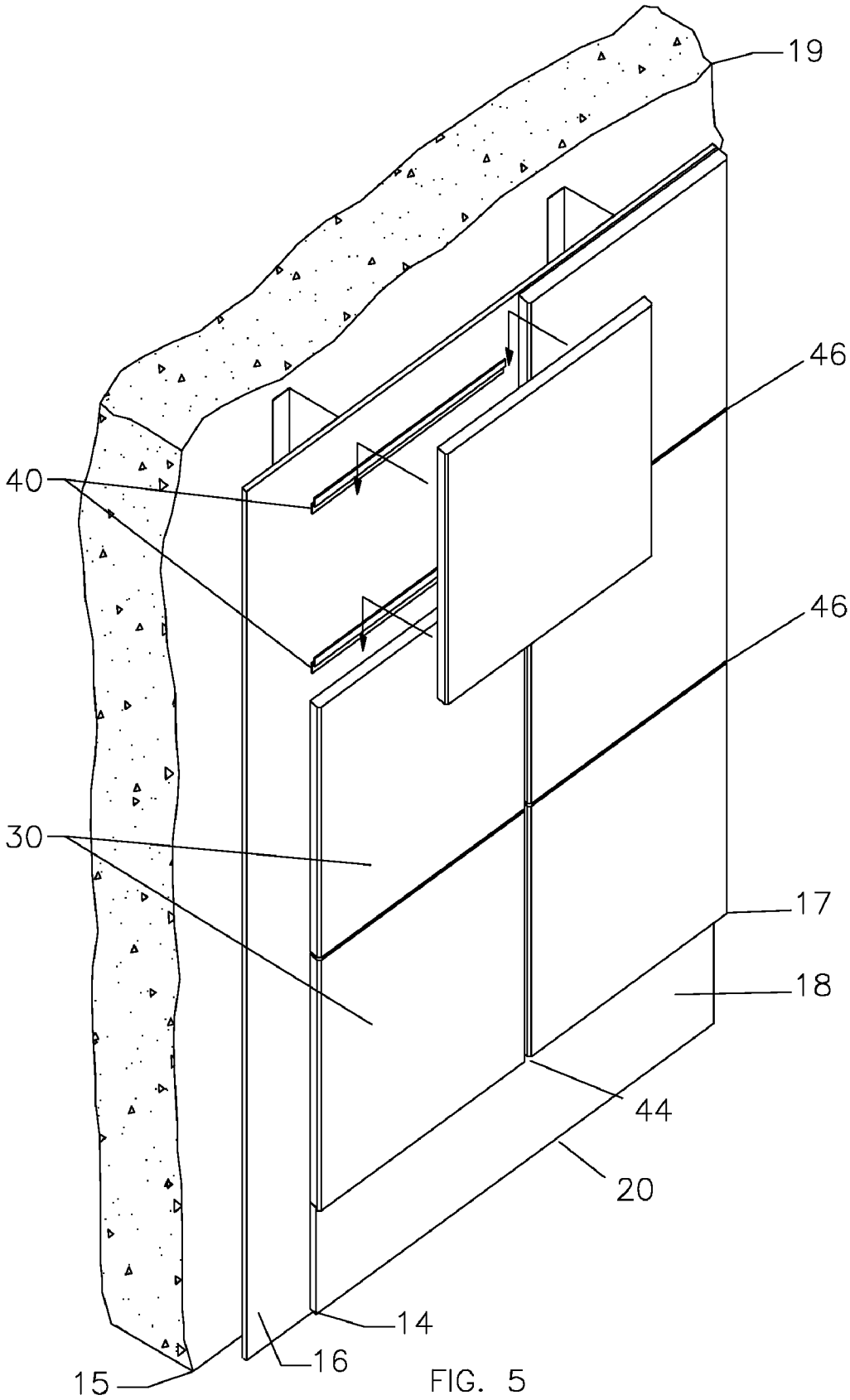
FIG. 5 is a perspective assembly view of a wall panel system mounted to a wall.

In an embodiment, the mounting member 38 comprises a clip. In an embodiment, the mounting member 38 comprises a mounting clip. In an embodiment, the mounting member 38 comprises a z-clip: In an embodiment, the mounting member 38 comprises a 2 inch wide clip that is twenty-four inches on center. In an embodiment, the mounting member 38 comprises a 2 inch wide mounting z-clip that is twenty-four inches on center. In an embodiment, the mounting member 38 is a clip that is fastened to the substrate on one end and fastened to the wall mount 40 (as shown in FIG. 5) on the other end. In an embodiment, the mounting member 38 is a z-clip that engages the wall mount 40 (as shown in FIG. 5). In an embodiment, the mounting member 38 is a z-clip that mates with the wall mount 40 shown in FIG. 5.

As shown in FIG. 5, each wall panel 30 is installed over an existing structure 16. In an embodiment, each panel is installed over the existing structure using a mounting system that is integrated seamlessly with a plurality of vertical reveals 44 and a plurality horizontal reveals 46. In an embodiment, a plurality of vertical reveals 44 overlay a plurality of horizontal reveals 46. In an embodiment, a plurality of horizontal reveals 46 overlay a plurality of vertical reveals 44. In an embodiment, a plurality of vertical reveals 44 overlay a plurality of horizontal reveals 46 and a plurality of horizontal reveals 46 overlay a plurality of vertical reveals 44. For example, vertical reveals may overlay horizontal reveals between panels and horizontal reveals may overlay vertical reveals between a panel and a door or at the end of a wall of the wall panel system.

In an embodiment, the mounting system comprises a plurality of mounting members 38 (as shown in FIG. 4) and a plurality of wall mounts 40 (as shown in FIG. 5). Each mounting member engages a wall mount to form a secure, flexible lock. The secure flexible lock formed by engaging a mounting member with a wall mount provides for a modular wall panel system with removable panels. In an embodiment, each panel of the wall panel system is removable. Upon engaging each mounting member to each wall mount, the panels are secured to the existing structure to form a stable, high impact resistant wall system comprising a plurality of high impact resistant wall panels. The high impact wall panels are resistant to superficial cracking, hairline cracking, complete penetration, or similar damage. The high impact resistant wall panels disclosed herein are useful in a variety of commercial applications where walls are subject to an increased risk of damage from abuse. In such environments, abuse may damage a panel beyond repair, thus requiring replacement of a panel. The modular, removable panel system disclosed herein provides for the instant removal of a single panel for repair or replacement rather than requiring removal of additional panels adjacent to the damaged panel.

Wall panel systems using construction grade adhesives to secure panels to underlying walls require progressive panel removal where each panel in a line of successive panels must be removed to remove an individual panel downstream that is in need of repair. For example, panel repair for a progressive removable panel system would require removal of the drywall to the framing studs, installation of new drywall, as many as three coats of compound with interim sanding and a final step of painting. Since matching existing paint is difficult, entire walls are often repainted. Bypassing the added expenses of repairing damaged progressive removable panels, the removable wall panel system of the presently disclosed embodiments provides for instant repair of any panel damaged in the system without removing adjacent panels. The wall panel system of the presently disclosed embodiments provides a removable wall panel system that permits removal of individual panels without affecting adjacent panels and does not require progressive panel removal. Thus, the wall panel system is useful for easier and quicker panel repair and panel replacement.

A method for mounting a wall panel to an existing structure includes installing at least one wall mount, wherein the wall mount may be shimmed as required to keep the wall mount level; installing at least one mounting member, wherein the mounting member is secured to a back side of the panel, wherein the mounting member is secured to the back side of the panel in at least one pre-drilled pilot hole; engaging each mounting member to each wall mount. In an embodiment, the method for mounting a wall panel includes installing additional end members and corner members as needed.

A method for mounting a wall panel system to an existing structure includes installing at least one wall mount, wherein the wall mount may be shimmed as required to keep the wall mount level; installing at least one mounting member, wherein the mounting member is secured to a back side of the panel, wherein the mounting member is secured to the back side of the panel in at least one pre-drilled pilot hole; engaging each mounting member to each wall mount; repeating installation of the wall mounts and the mounting members as many times as necessary to add as many panels are necessary to complete requirements for a particular installation.

A method for removing a panel includes disengaging a panel from an existing structure, wherein disengagement of the panel comprises disengaging at least one mounting member of the panel from at least one wall mount, wherein upon disengagement of each mounting member of the panel from the wall mount a panel is capable of being removed, wherein upon disengagement of each mounting member, each mounting member remains secured to the panel and each wall mount remains secured to the wall; and removing the disengaged panel from the existing structure.

A method of replacing at least one panel includes providing one high impact, moisture resistant panel to replace each removed panel, wherein each panel has a front face and a back face; and providing at least one mounting member having a first end and a second end, wherein the first end of the mounting member is secured to the back face of the panel; and engaging the second end of each mounting member with the second end of each wall existing wall mount residing on the existing structure, wherein engagement of the mounting member with the wall mount secures the panel to the existing structure in a substantially parallel manner.

A method for configuring at least one panel to form a high impact, moisture resistant wall panel system includes providing at least one panel for each panel being removed, and providing a wall mount, wherein the wall mount is installed in horizontal orientation across a wall span beginning at a first end and continuing to a second end, wherein the wall mount may be installed between a ceiling and the panel or the wall mount may be installed between a base and the panel or the wall mount may be installed between adjacent panels, wherein the wall mount forms a continuous horizontal reveal beginning at the first end and continuing to the second end; and providing a vertical reveal, wherein the vertical reveal intersects with the horizontal reveal in at least one joint between adjacent panels, and wherein the vertical reveal is integrated with the horizontal reveal; and engaging the second end of each mounting member with the second end of each wall mount, wherein engagement of the mounting member with the wall mount secures the panel to the existing structure in a substantially parallel manner.

Figure 6:
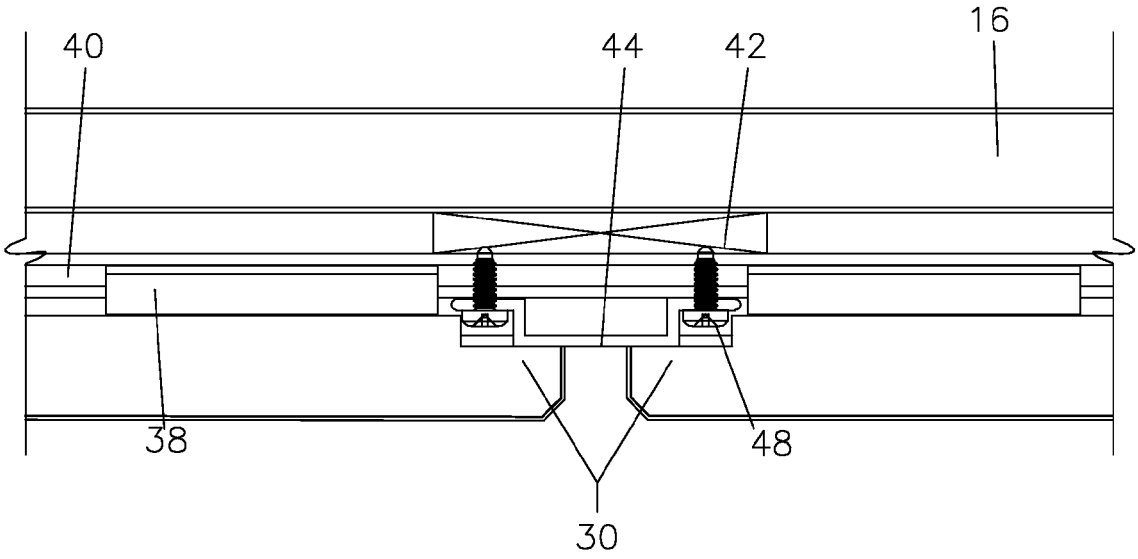
FIG. 6 is a cross-section view of a representative vertical joint and adjacent panels.

FIG. 6 shows a top cross-sectional view of a vertical joint and adjacent panels. In an embodiment, the joint is an expansion joint. As shown in FIG. 6, each panel 30 is placed adjacent each other with sufficient space between the panels to form a vertical reveal 44 between the panels. Each panel 30 has a mounting member 38 approximately near the undercut 28 edge of each panel 30 that engages a wall mount 40 that is secured to the existing structure 16.

Figure 7:
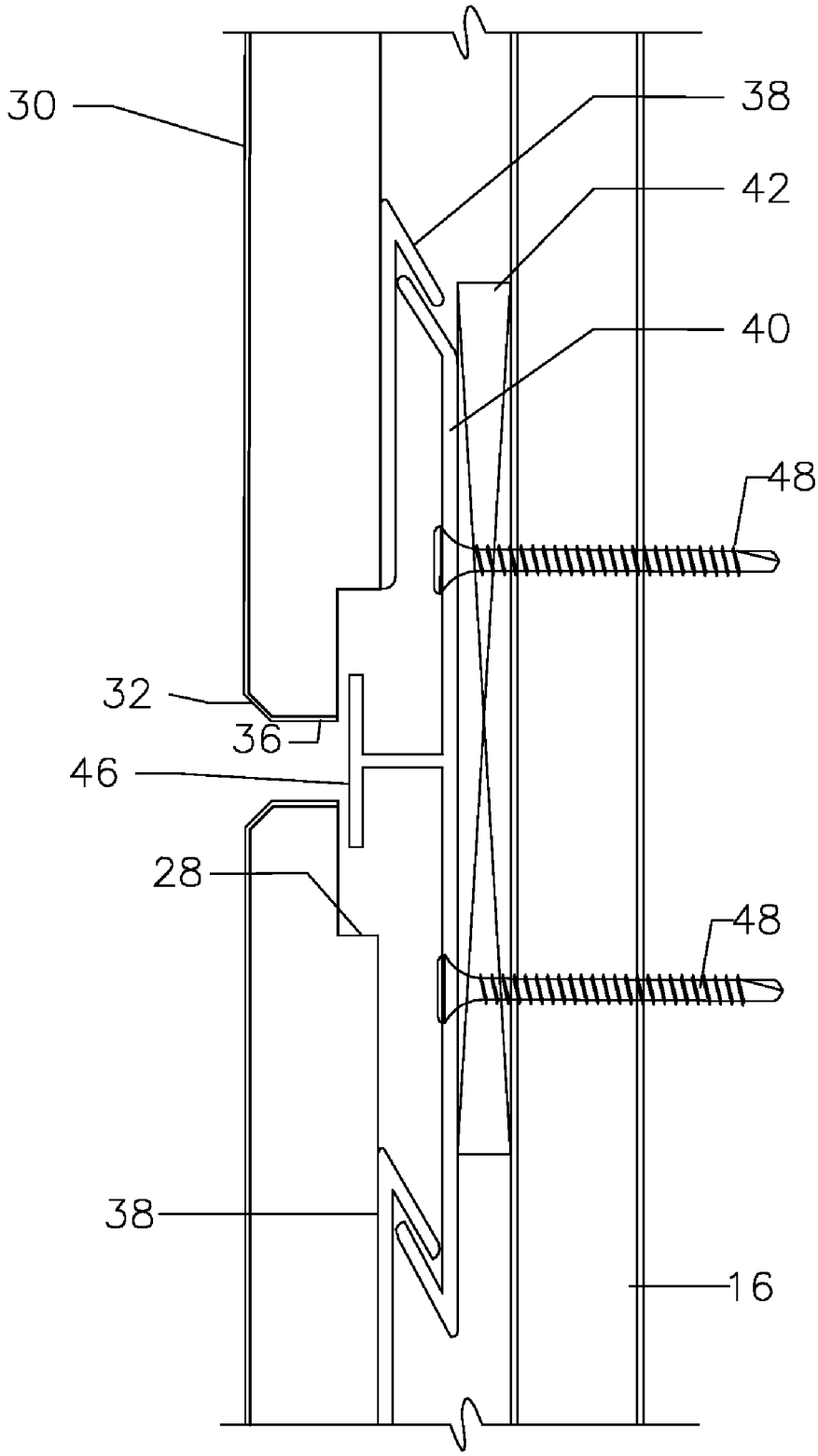
FIG. 7 is a cross-section view of a representative horizontal joint and adjacent panels.

In an embodiment, the wall mount 40 spans across the horizontal length of the wall panel system forming a horizontal reveal 46 (as shown in FIG. 7) between two adjacent panels side-by-side stacked one above the other. In an embodiment, the vertical reveal 44 abuts each panel approximately near and approximately along the undercut edge 28. In an embodiment, the vertical reveal overlays the wall mount 40 and is secured to the wall mount with at least one screw 48. The wall mount 40 is secured to the existing structure 16 with a at least one screw (as shown in FIG. 7). In an embodiment, at least one shim 42 is used to ensure that the panels secured to the existing structure are plumb and level. In an embodiment, no shim is used to keep the panels level and plumb.

A screw 48 of the presently disclosed embodiments includes, but is not limited to a self-tapping screw, a self-drilling screw, a self-tapping pan screw, a self-drilling pan screw, a zinc plated self-tapping pan screw, a zinc-plated self-drilling pan screw, a dry-wall screw, or a sheet metal screw.

FIG. 7 shows a side cross-sectional view of a horizontal joint and adjacent panels stacked one above another in vertical orientation. In an embodiment, the joint is an expansion joint. As shown in FIG. 7, each panel 30 is placed adjacent each other with sufficient space between the panels to form a horizontal reveal 46 between the panels. Each panel 30 has a mounting member 38 approximately near the undercut 28 edge of each panel that mates with a wall mount 40 that is secured to the existing structure with at least one screw 48.

The horizontal reveal 46 integrates seamlessly with the wall mount 40 to form a wall mounting system. In an embodiment, the wall mounting system comprises extrusions. In an embodiment, the wall mounting system is aluminum. In an embodiment, the wall mounting system is an aluminum extrusion. In an embodiment, the wall mounting system integrates seamlessly with the horizontal reveal 46 and spans across the full horizontal length of the wall panel system. In an embodiment, at least one shim 42 may be placed between the wall mount 40 and the existing structure 16 to ensure a level and plumb installation of the wall panel system. In an embodiment, no shim is used to keep the panels level and plumb.

In an embodiment, a means for securing a panel to the existing structure is provided comprising a mounting member 38, a wall mount 40, and at least one screw 48. Any means for securing the panel to the existing structure will suffice. In an embodiment, the means for securing comprises a mounting clip. In an embodiment, the means for securing comprises a z-clip. In an embodiment, the means for securing comprises a two inch wide mounting clip that is twenty-four inches on center. Those skilled in the art will recognize that other mounting systems known in the art may be used within the spirit and scope of the presently disclosed embodiments.

Figure 8:
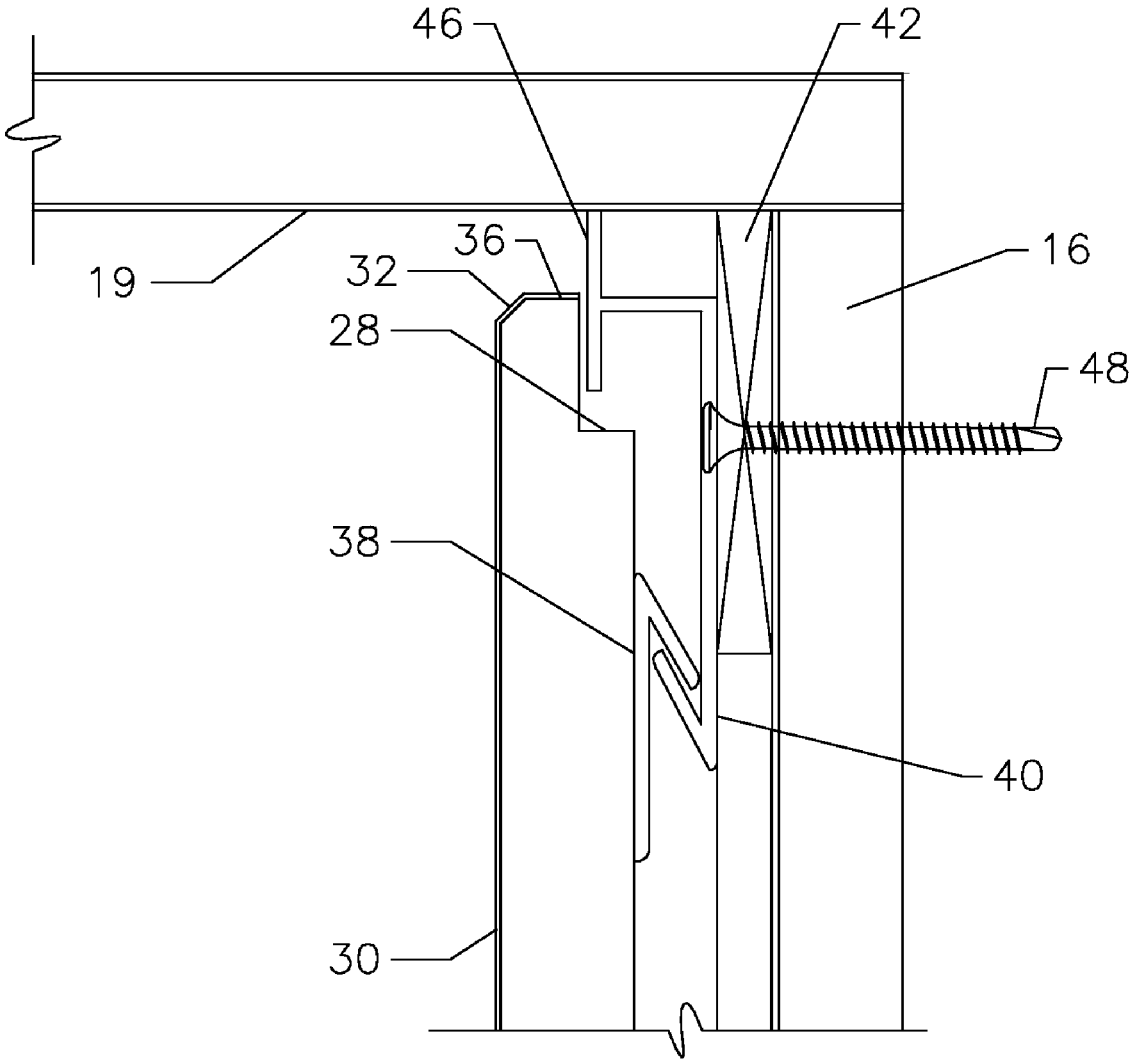
FIG. 8 is a cross-section view of a representative joint between a panel and a ceiling.

FIG. 8 shows side cross-sectional view of a horizontal joint between a panel 30 and a ceiling 19. In an embodiment, the joint is an expansion joint. As shown in FIG. 8, a panel 30 is placed adjacent the ceiling leaving sufficient space between the panel and the ceiling to form a horizontal reveal 46 in between the panel and the ceiling 19. The horizontal reveal 46 may have any thickness. In an embodiment, the horizontal reveal approximates to ⅜ inch thick. Each panel 30 has a mounting member 38 approximately near the undercut 28 edge of each panel that engages a wall mount 40 that is secured to the existing structure with at least one screw 48. In an embodiment, the horizontal reveal 46 is integrated seamlessly with the wall mount and spans across the full horizontal length of the wall panel system. In an embodiment, the horizontal reveal 46 approximately fills the space between the ceiling 19 and the undercut edge 28 of the panel 30. In an embodiment, the horizontal reveal fills the space between the ceiling and the undercut edge of the panel. In an embodiment, the horizontal reveal abuts the ceiling and approximately fills the space near the undercut edge. In an embodiment, at least one shim 42 between the wall mount 40 and the existing structure 16 ensures a level and plumb installation of the wall panel system. In an embodiment, no shim is used to keep the panels level and plumb. In an embodiment, at least one screw 48 secures the wall mount to the existing structure.

FIG. 9 shows a side cross-sectional view of a bottom panel 30 near a base 18. In an embodiment, the base 18 is a stainless steel base. In an embodiment, the base 18 comprises a panel cut to fit between a panel and the floor 15. In an embodiment, the base 18 is designed to match its surrounding environment. As shown in FIG. 9, a base 18 is attached to the existing structure 16 and approximately fills the space near the undercut edge 28 of the panel. In an embodiment, the base fills the space near the undercut edge of the panel. Each panel 30 is secured to the existing structure 16 with a mounting system comprising a mounting member 38 that is secured to the panel on one end, wherein the mounting member 38 engages a wall mount 40 on the other end. Engagement between the mounting member and the wall mount forms a secure, flexible lock that provides for stable, yet removable panels. The wall mount is secured to the existing structure with at least one screw 48.

In an embodiment, a means for connecting a panel to an existing structure is provided comprising a mounting system. The mounting system further comprises at least one screw and at least one clip. In an embodiment, the mounting system comprises a mounting member 38 and a wall mount 40. In an embodiment, the mounting system comprises at least one screw 48. In an embodiment, the mounting system uses a shim 42 to keep the panel plumb and level with respect to the existing structure. In an embodiment, no shim is used to keep the panels level and plumb.

Figure 10:
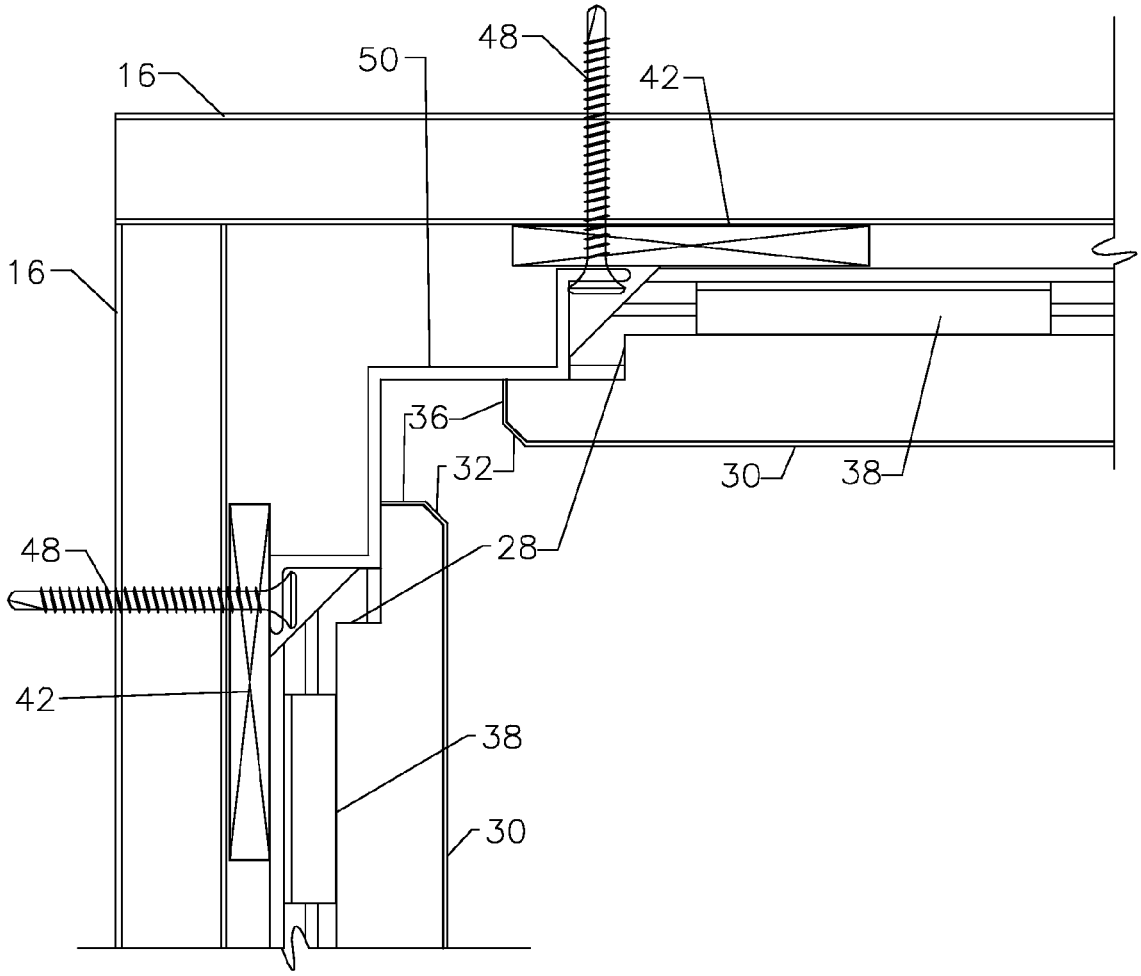
FIG. 10 is a cross-section view of a representative inside-corner joint and adjacent panels.

FIG. 10 shows a top cross-sectional view of an inside corner joint between two adjacent corner panels. In an embodiment, the joint is an expansion joint. As shown in FIG. 10, each panel 30 abuts a central corner member 50 leaving sufficient space between each panel to form a vertical reveal 44 (as shown in FIG. 6). The vertical reveal 44 may have any thickness. In an embodiment, the vertical reveal is about ⅜ inch wide. At least one screw 48 secures the corner member to the existing structure 16. In an embodiment, the corner member 50 is an inside corner guard. In an embodiment, the corner member 50 is an inside corner molding. In an embodiment, the corner member 50 is an inside corner trim. In an embodiment, the corner member 50 is an inside corner connector. In an embodiment, at least one shim 42 is placed between the corner member 50 and the existing structure 16 to maintain level panels. In an embodiment, no shim is used to keep the panels level and plumb. In an embodiment, the corner member 50 abuts each panel 30 along the undercut edge 28. In an embodiment, the corner member 50 approximately fills the space near the undercut edge 28. In an embodiment, there is an axis of symmetry parallel to the beveled edges 32 of each panel 30.

A mounting member 38 is affixed to each panel 30 approximately near the undercut edge 28 of the panel. In an embodiment, the mounting member engages a wall mount 40 which in turn is secured to the existing structure 16 with at least one screw 48. In an embodiment, at least one shim 42 is used to ensure that the panels are level and plumb with the existing structure. In an embodiment, no shim is used to keep the panels level and plumb.

Figure 11:
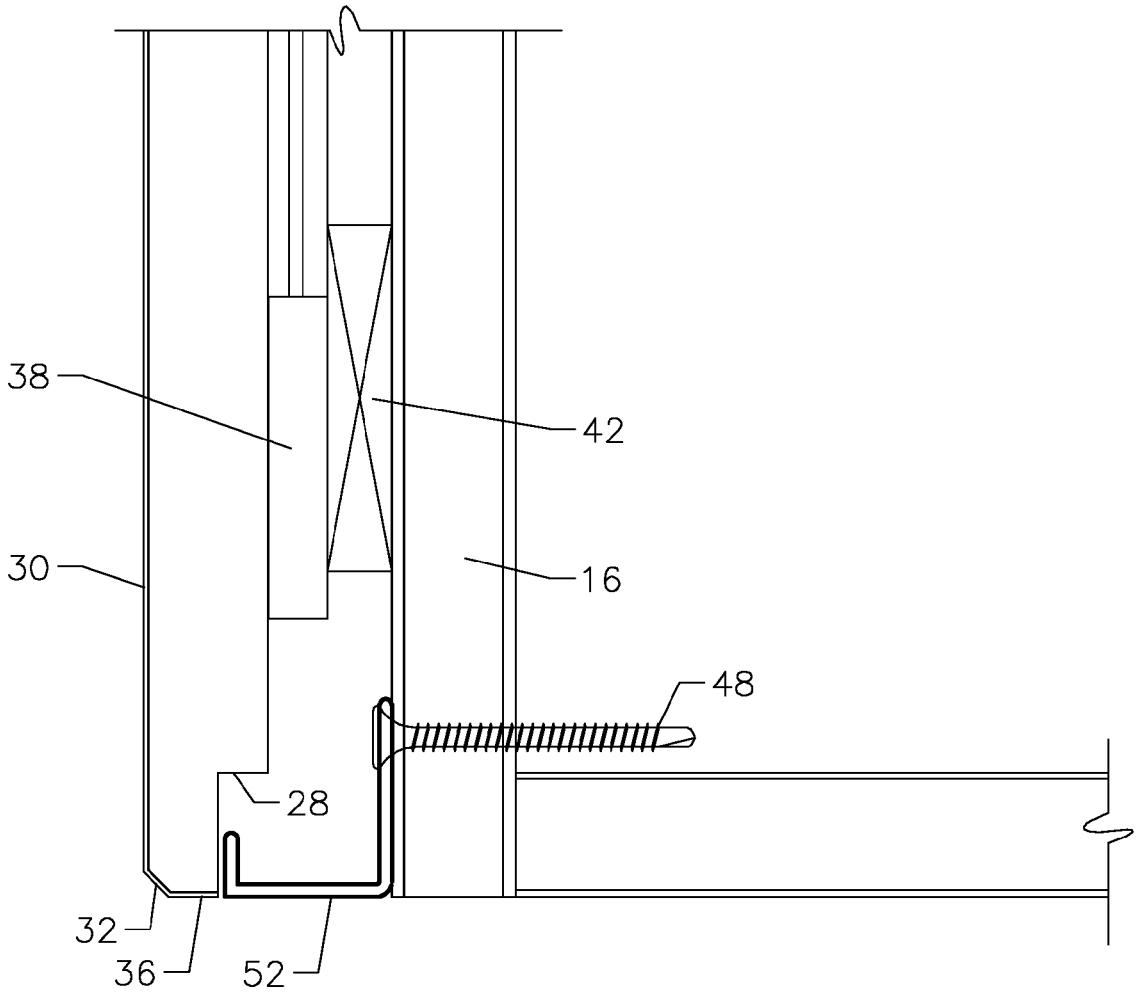
FIG. 11 is a cross-section view of a representative panel at the end of the wall panel system.

FIG. 11 shows a top cross-sectional view of a panel at an end of the wall panel system. As shown in FIG. 11, an end member 52 is secured to the existing structure 16 with at least one screw 48. The end member 52 abuts against the undercut edge 28 of the panel 30. In an embodiment, the end member 52 approximately fills the space near the undercut edge. In an embodiment, the end member fills the space between the undercut edge and the existing structure. In an embodiment, a mounting member 38 is affixed approximately near the undercut edge 28 of each panel 30. The mounting member 38 engages a wall mount 40 which is secured to the existing structure 16 with at least one screw 48.

Figure 12:
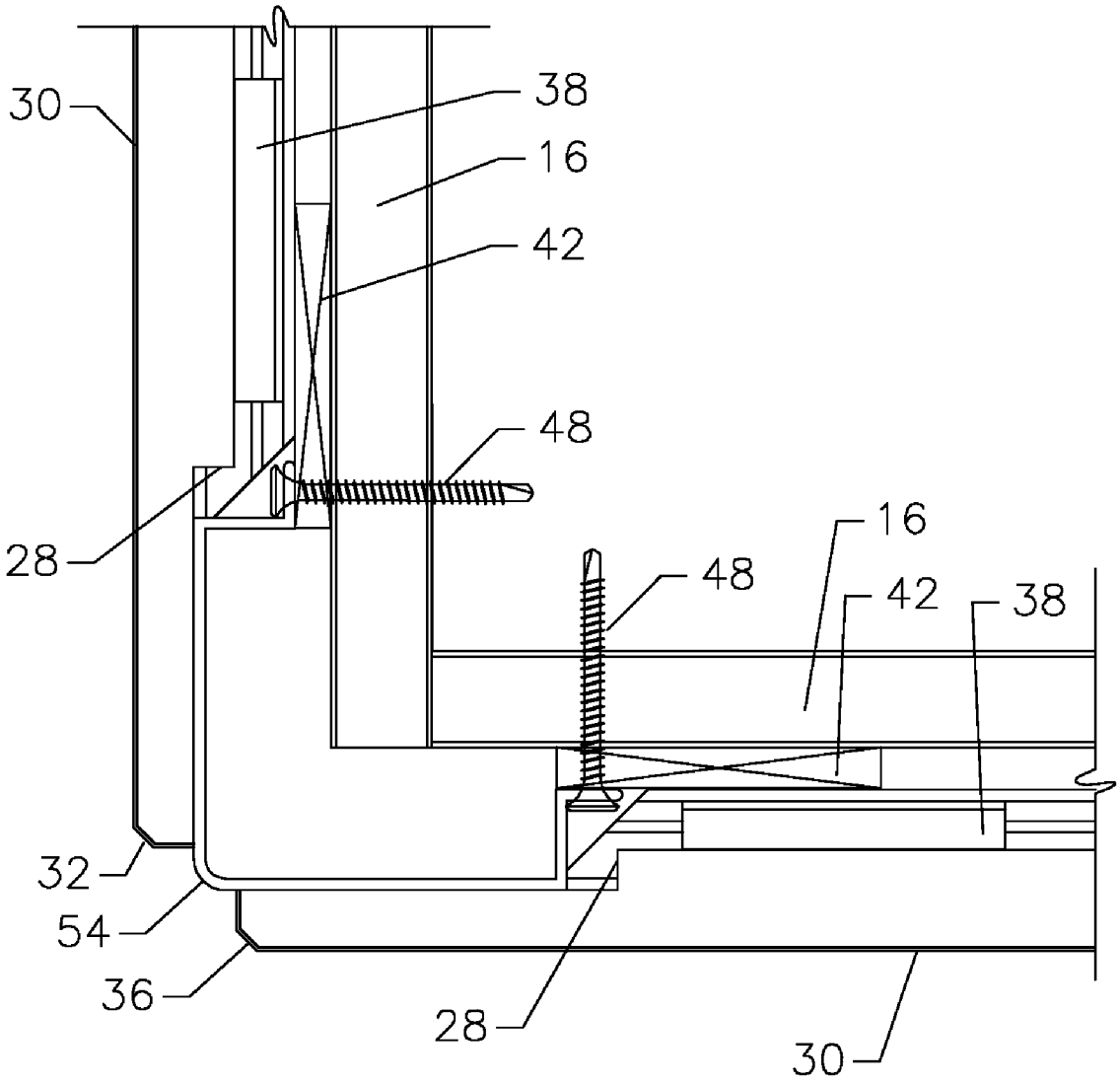
FIG. 12 is a cross-section view of a representative outside-corner joint.

FIG. 12 shows a top cross-sectional view of an outside corner joint between adjacent corner panels. In an embodiment, the joint is an expansion joint. As shown in FIG. 12, each panel 30 abuts a corner member 54 approximately near the undercut edge 28 of each panel leaving sufficient space between the panels to form a vertical reveal 44. The vertical reveal 44 may have any thickness. In an embodiment, the vertical reveal is about ⅜ inch wide. The corner member is secured to the existing structure with at least one screw 48. In an embodiment, the corner member 54 fills the space near the undercut edge 28 of each panel 30. In an embodiment, the corner member 54 approximately fills the space near the undercut edge 28 of each panel 30. In an embodiment, the corner member 54 is an outside corner guard. In an embodiment, the corner member 54 is an outside corner molding. In an embodiment, the corner member 54 is an outside corner trim. In an embodiment, the corner member 54 is an outside corner connector. In an embodiment, a at least one shim 42 is placed between the corner member 54 and the existing structure 16 to maintain level panels. In an embodiment, no shim is used to keep the panels level.

Each panel 30 is secured to the existing structure 16 by engaging a mounting member 38 with a wall mount 40 to form a secure, flexible lock that provides removable panels. In an embodiment, at least one shim 42 is placed between the wall mount 40 and the existing structure to ensure a level panel installation. In an embodiment, no shim is used to keep the panels level.

The wall panel system also contemplates moldings that may be adapted to the needs of a particular job design. Provisions for making and adapting moldings to panel systems are known in the art. Moldings may be extruded from the same polymer composition used to form the laminate sheets and are preferably formed from polyvinyl chloride, to which a proportionately smaller amount of acrylic is added. Those skilled in the art will recognize other moldings that may be adapted for use in the presently disclosed embodiments.

The removable high impact, moisture resistant panels of the presently disclosed embodiments have been tested for and are in compliance with international standards including, but not limited to ASTM E 84-07 for fire performance.

A panel of the presently disclosed embodiments has a Class A Flame Spread Index/Smoke Developed Index per ASTM E84-07/UL723. ASTM E84-07/UL723 determines the surface burning characteristics of the material, specifically the flame spread and smoke developed indices when exposed to fire. The maximum distance the flame travels along the length of the sample from the end of the igniting flame is determined. Test results are shown in Table 1.

TABLE 1

ASTM E84-07/UL723 Flame Spread Test Results

| Test Sample | Calculated Flame Spread | Flame Spread Index | Calculated Smoke Developed | Smoke Developed Index |
|---|---|---|---|---|
| White Panel | 10.58 | 10 | 352.6 | 350 |

All patents, patent applications, and published references cited herein are hereby incorporated by reference in their entirety. It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A wall comprising:

a structure including a first mounting, the first mounting having a base secured to the structure and a hook;

a plurality of high impact panels, the plurality of panels including a first panel adjacent to second, third and fourth panels on three respective sides, each panel including:

an inert substrate composed of a high density, dimensionally stable inorganic material;

a laminate composed of substantially rigid polymeric material, wherein the laminate provides a finished surface and wherein the laminate encapsulates a plurality of side surfaces of the substrate;

an adhesive to secure the laminate to the substrate, and a second mounting for mating with the first mounting, the second mounting having a base secured to the substrate and a hook for removably engaging with the hook of the first mounting secured to the structure; and a space between side surfaces of the first, second, third and fourth adjacent panels to form a reveal between adjacent panels, and wherein each panel may be individually mounted and individually removed without moving the second, third and fourth adjacent panels;

wherein disengaging the second mounting from the first mounting permits each of the plurality of panels to be individually removed without removing adjacent panels;

wherein engaging the second mounting to the first mounting permits each of the plurality of panels to be individually replaced without removing adjacent panels; and wherein the plurality of panels are securely mounted adjacent to each other in a horizontal and vertical relationship on the structure thereby to form a wall with the finished surface exposed.

2. The wall of claim 1 wherein each panel is removable by disengaging the hook of the first mounting from the hook of the second mounting.

3. The wall of claim 1 wherein the structure further includes a third mounting, the third mounting having a base secured to the structure and a hook; and wherein each panel further includes a fourth mounting for mating with the third mounting, the fourth mounting having a base secured to the substrate and a hook for removably engaging with the hook of the third mounting secured to the structure; and wherein the base of the second mounting is secured towards a top of each panel and wherein the base of the fourth mounting is secured towards a bottom of each panel.

4. The wall of claim 3 wherein each panel is solely mounted to the structure by the engagement of the hook of the first mounting with the hook of the second mounting and the engagement of the hook of the third mounting with the hook of the fourth mounting and wherein the structure is without external framing elements about an edge of each panel.

5. The wall of claim 1 wherein the panel is fire resistant without requiring at least one fire retardant.

6. The wall of claim 1 wherein the panel is moisture resistant without requiring an additional protective coating, layer or vapor barrier.

7. The wall of claim 1 wherein each panel further includes:

a side edge of the laminate, wherein the side edge is substantially perpendicular to a front face of the laminate; and a beveled interface between the side edge and the front face, wherein the beveled interface includes a beveled edge of the substrate that underlies a beveled edge of the laminate and wherein the laminate encapsulates all side surfaces of the substrate.

8. The wall of claim 1 wherein the laminate seamlessly and contiguously covers and bonds with a front face and a plurality of side edges of the substrate.

9. The wall of claim 1 wherein the substrate is moisture resistant, fire resistant and is dimensionally stable in response to changes in temperature and humidity.

10. A wall comprising:

a structure including a first mounting, the first mounting having a base secured to the structure and a hook;

a plurality of high impact panels, the plurality of panels including a first panel adjacent to second, third and fourth panels on three respective sides, each panel including:

an inert substrate composed of a high density inorganic material, wherein the inorganic material is moisture resistant without requiring an additional protective coating, layer or vapor barrier, is fire resistant and is dimensionally stable in response to changes in temperature and humidity;

a laminate composed of substantially rigid polymeric material, wherein the laminate provides a finished surface and wherein the laminate encapsulates a plurality of side surfaces of the substrate;

an adhesive to secure the laminate to the substrate, and a second mounting for mating with the first mounting, the second mounting having a base secured to the substrate and a hook for removably engaging with the hook of the first mounting secured to the structure; and a space between side surfaces of the first, second, third and fourth adjacent panels to form a reveal between adjacent panels, and wherein each panel may be individually mounted and individually removed without moving the second, third and fourth adjacent panels;

wherein disengaging the second mounting from the first mounting permits each of the plurality of panels to be individually removed without removing adjacent panels;

wherein engaging the second mounting to the first mounting permits each of the plurality of panels to be individually replaced without removing adjacent panels; and wherein a wall with the finished surface exposed is assembled by securely mounting the plurality of panels adjacent to each other in a horizontal and vertical relationship on the structure and wherein the wall can be disassembled by removing at least one panel of the plurality of panels from the structure.

11. The wall of claim 10 wherein each panel can be disassembled by disengaging the hook of the first mounting from the hook of the second mounting.

12. The wall of claim 10 wherein each panel further includes:

a side edge of the laminate, wherein the side edge is substantially perpendicular to a front face of the laminate; and a beveled interface between the side edge and the front face, wherein the beveled interface includes a beveled edge of the substrate that underlies a beveled edge of the laminate and wherein the laminate encapsulates all side surfaces of the substrate.

13. The wall of claim 10 wherein the structure further includes a third mounting, the third mounting having a base secured to the structure and a hook; and wherein each panel further includes a fourth mounting, for mating with the third mounting, the fourth mounting having a base secured to the substrate and a hook for removably engaging with the hook of the third mounting secured to the structure; and wherein the base of the second mounting is secured towards a top of each panel and wherein the base of the fourth mounting is secured towards a bottom of each panel.

14. The wall of claim 13 wherein each panel is solely mounted to the structure by the engagement of the hook of the first mounting with the hook of the second mounting, and the engagement of the hook of the third mounting with the hook of the fourth mounting.

15. The wall of claim 1 wherein a vacuum forming process is used to bond the laminate to the substrate.

16. The wall of claim 10 wherein a vacuum forming process is used to bond the laminate to the substrate.

17. A wall comprising:

a structure including a first mounting, the first mounting having a base secured to the structure and a hook;

a plurality of high impact panels, the plurality of panels including a first panel between a second and third panel, the first, second and third panels being vertically aligned, each panel including:

an inert substrate composed of a high density, dimensionally stable inorganic material;

a laminate composed of substantially rigid polymeric material, wherein the laminate provides a finished surface and wherein the laminate encapsulates a plurality of side surfaces of the substrate;

an adhesive to secure the laminate to the substrate, and a second mounting for mating with the first mounting, the second mounting having a base secured to the substrate and a hook for removably engaging with the hook of the first mounting secured to the structure; and a space between side surfaces of the first, second, third and fourth adjacent panels to form a reveal between adjacent panels, and wherein each panel may be individually mounted and individually removed without moving the second, third and fourth adjacent panels; and wherein disengaging the second mounting from the first mounting permits each of the plurality of panels to be individually removed without removing adjacent panels;

wherein engaging the second mounting to the first mounting permits each of the plurality of panels to be individually replaced without removing adjacent panels; and wherein the plurality of panels are securely mounted adjacent to each other in a horizontal and vertical relationship on the structure thereby to form a wall with the finished surface exposed.

18. The wall of claim 1 further comprising a reveal behind each space between panels and wherein the reveal extends across each space such that the reveal blocks view of the structure.

19. The wall of claim 10 further comprising a reveal behind each space between panels and wherein the reveal extends across each space such that the reveal blocks view of the structure.

20. The wall of claim 17 further comprising a reveal behind each space between panels and wherein the reveal extends across each space such that the reveal blocks view of the structure.

* * * * *